US005831215A

United States Patent [19]

Ziemek et al.

[11] Patent Number: 5,831,215

[45] Date of Patent: Nov. 3, 1998

[54] HIGH FREQUENCY COAXIAL CABLE

[75] Inventors: Gerhard Ziemek, Langenhagen; Horst Fischer, Hannover, both of Germany

[73] Assignee: Alcatel Kabel AG & Co., Germany

[21] Appl. No.: 507,799

[22] Filed: Jul. 26, 1995

[30] Foreign Application Priority Data

Aug. 2, 1994 [DE] Germany ..... 44 272 82.0

[51] Int. Cl.[6] ..... H01B 7/18; H01B 9/02

[52] U.S. Cl. ..... 174/108; 174/110 R; 174/36

[58] Field of Search ..... 174/36, 108, 107, 174/110 R; 439/445, 448

[56] References Cited

U.S. PATENT DOCUMENTS

| | | | |
|---|---|---|---|
| 2,845,473 | 7/1958 | Doherty | 174/34 X |
| 3,688,016 | 8/1972 | Spade | 174/36 |
| 3,783,180 | 1/1974 | Spicer | 174/110 R |
| 5,210,377 | 5/1993 | Kennedy et al. | 174/107 |
| 5,230,260 | 7/1993 | Bell | 81/9.4 X |
| 5,423,884 | 6/1995 | Nyman et al. | 607/127 X |

FOREIGN PATENT DOCUMENTS

| | | |
|---|---|---|
| PS863378 | 11/1952 | Germany . |
| 2522447 | 2/1975 | Germany . |
| 3936431 | 1/1991 | Germany . |

*Primary Examiner*—Kristine L. Kincaid
*Assistant Examiner*—Chau N. Nguyen
*Attorney, Agent, or Firm*—Ware, Fressola, Van der Sluys & Adolphson LLP

[57] ABSTRACT

A high frequency coaxial cable (1) contains a concentric internal conductor (3), a cylindrical insulating layer (7) surrounding the internal conductor (3) and made of a foamed plastic containing more than 50% by volume of air, a tubular external conductor (9) placed over the insulating layer (7), and an outer sheath (11). Cutouts (15, 15') are made in the insulating layer (7) by removing insulation material starting at the periphery (13) of the insulating layer and extending radially inward. These cutouts (15, 15') make it possible to increase the dielectric properties of the insulating layer between internal conductor (3) and external conductor (9).

24 Claims, 7 Drawing Sheets

HIGH FREQUENCY COAXIAL CABLE

BACKGROUND OF THE INVENTION

1. Technical Field

The invention relates to (1) a high frequency coaxial cable with an internal conductor, an insulating layer of foamed plastic which concentrically surrounds the internal conductor and contains more than 50% by volume of air, a tubular external conductor placed over the insulating layer and an outer sheath, and (2) a method for producing such a high frequency coaxial cable.

2. Description of the Prior Art

A high frequency coaxial cable is already known from DE 39 36 431 C1, wherein a foam material is used as the insulating layer surrounding the internal metal conductor, whereby expensive spacers between the internal and external conductors can be omitted. Since plastics have poorer dielectric values than air, foamed plastics containing more than 50% by volume of air additionally provide an improvement in the dielectric values of the insulating layer. For manufacturing reasons and for reasons of sufficient stability of the high frequency cable, the air portion of the foamed plastic cannot be increased to any desired degree to further improve the dielectric values of the foamed plastic layer.

SUMMARY OF THE INVENTION

Starting with the high frequency coaxial cable known from DE 39 36 431 C1, the present invention is designed to solve the problem of further improving the dielectric values of the foamed plastic insulating layer between the concentric internal conductor and the tubular external conductor.

The problem is solved by providing radially inward extending cutouts in the insulating layer, i.e., by removing insulation material from the peripheral surface of the insulating layer after the insulating layer has hardened. The cutouts can be helical, circular, semi-circular or linear in form.

The cutouts increase the amount of air in the foamed plastic, thereby improving the dielectric properties of the insulating layer. Ideally, the portion of air in the insulation material of the insulating layer is greater than 70% by volume. In spite of the cutouts, sufficient high strength is ensured in the insulating layer of the high frequency cable.

For a particularly effective increase in the air portion of the insulating layer, it is advantageous for the cutouts to extend radially inward to the surface of the internal conductor or to the surface of an intermediate layer placed between the internal conductor and the insulating layer. To ensure the waterproof longitudinal sealing of the high frequency cable of the invention, it is advantageous if the insulating layer has full cylindrical sections, with no cutouts made therein, spaced along the length of the high frequency cable.

To avoid reflection factor peaks in the useful frequency range of the high frequency cable, it is an advantage if the spacing between adjacent full sectional cutouts is greater than 2.0 m and/or varies along the length of the cable. For the same reason, it is advantageous if the spaces between adjacent circular or semi-circular segment cutouts do not exceed 7.5 cm and/or vary along the length of the cable.

It is especially advantageous if the cutouts made in the insulating layer are helically shaped. Such helical cutouts can be produced in simple form and still provide high mechanical strength of the insulating layer, in spite of a considerable reduction in the amount of insulation material. To prevent reflection factor peaks in the useful frequency range of the high frequency cable, it is an advantage if the pitches (i.e., the distances between adjacent turns) of helical cutouts do not exceed 7.5 cm and/or vary along the length of the cable. To further improve the dielectric properties of the insulating layer, it is an advantage if helical cutouts with different pitches overlap.

For a simple configuration of the cutouts, the insulation material can be removed from the insulating layer by making parallel cuts using two parallel knives with a space between them, and removing the insulation material between them with a scraping tool. It is also possible to make the parallel cuts in the insulation material with high-pressure water jets or with saw blades. For a simple configuration of the cutouts, it is also possible to remove the insulation material from the insulating layer by milling.

In a particularly simple and cost-effective manufacturing technique for the high frequency cable of the invention, the removal of the insulation material from the insulating layer takes place continuously during the process of applying the external conductor.

The invention will be fully understood when reference is made to the following detailed description taken in conjunction with the accompanying drawings.

DETAILED DESCRIPTION OF THE INVENTION

Figure 1:
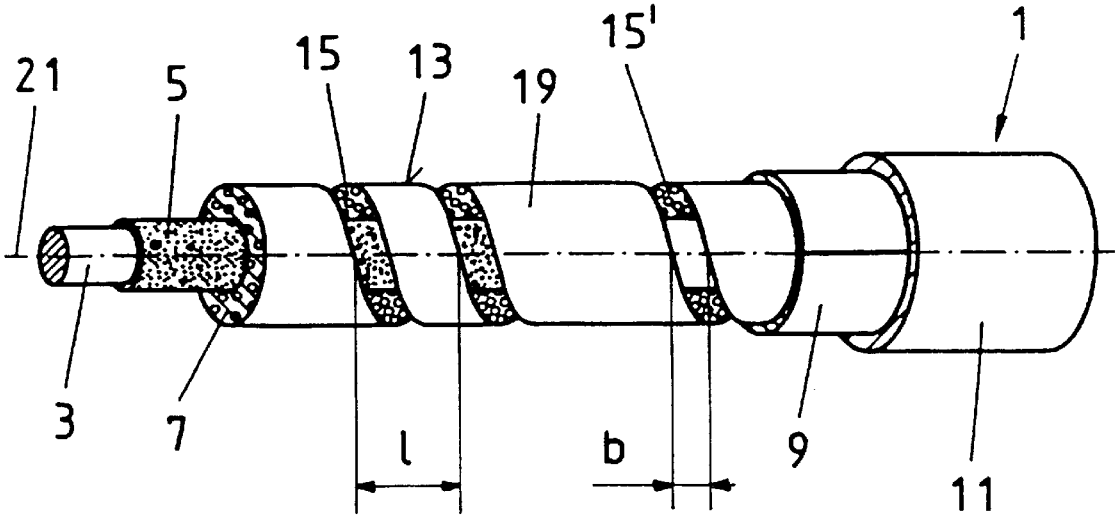
FIGS. 1–5 are perspective views of five embodiments of the high frequency coaxial cable of the present invention.

Turning to FIG. 1, therein is illustrated a first embodiment of the high frequency coaxial cable made in accordance with the present invention. The high frequency coaxial cable 1 contains a concentric, solid internal conductor 3 made of copper or a copper-plated material such as aluminum. An intermediate layer 5 made of plastic, e.g. an ethylene copolymer, is placed over the internal conductor 3. This is covered by a cylindrical insulating layer 7 made of a foamed plastic, which concentrically surrounds the internal conductor 3 and solidly adjoins the intermediate layer 5 surrounding the internal conductor 3. The insulating layer 7 can be made of a foamed polyethylene containing more than 70% by volume of air, e.g. about 80% or even somewhat higher. The insulating layer 7 is surrounded by a tubular external conductor 9, which is made of a longitudinally welded aluminum or copper band. The external conductor 9 is enclosed by an outer jacket 11 made of an electrically insulating plastic. Such a high frequency cable finds use as a so-called CATV cable.

The hardened insulating layer 7 contains successive helical cutouts or grooves 15, 15' made by mechanically removing insulation material in the radial inward direction, starting at the periphery 13 of the insulating layer. The cutouts 15, 15' have a width b of 10 to 50 mm, for example, 30 mm. Preferably, the cutouts 15, 15' each have a pitch 1 (the distance between adjacent turns) which does not exceed 7.5 cm. The removal of the insulation material also includes the disposal of insulation material. Between the two successive helical cutouts 15, 15' is a full foamed section 19 in which no cutouts have been made to ensure the waterproof longitudinal seal of the high frequency cable 1. Like the left cutout 15 in FIG. 1, the helical cutouts 15, 15' can extend radially inward to the surface of the intermediate layer 5 located between the internal conductor 3 and the insulating layer 7. Like the right cutout 15' in FIG. 1, they can also extend to the surface of internal conductor 3, thus laying bare the internal conductor in these areas, which would be the case in high frequency cables without an intermediate layer 5. In this manner, helix-shaped insulation spirals of foamed insulation material are formed between full sections 19 and surround the internal conductor 3.

Figure 2:
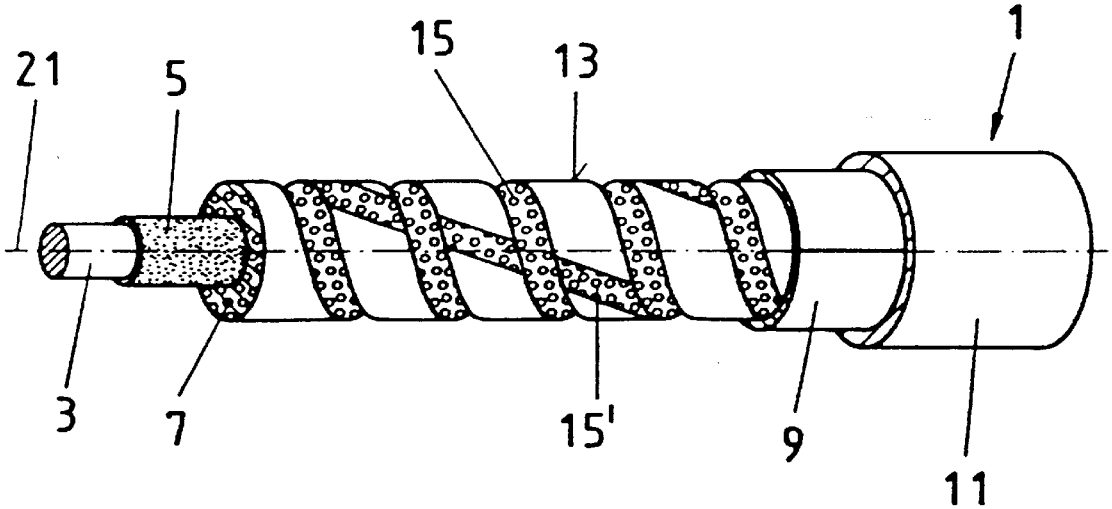

The second embodiment of the invention is illustrated in FIG. 2 and essentially differs from the first embodiment of the invention illustrated in FIG. 1 only in that the two helical cutouts 15, 15' are provided with different pitches and different depths and overlap each other. In this instance, the helical cutout 15 with a small pitch extends radially inward close to the surface of internal conductor 3, while the helical cutout 15' has a larger pitch and extends less in the radial inward direction. This double helix arrangement again increases the air portion in the insulating layer 7.

Figure 3:
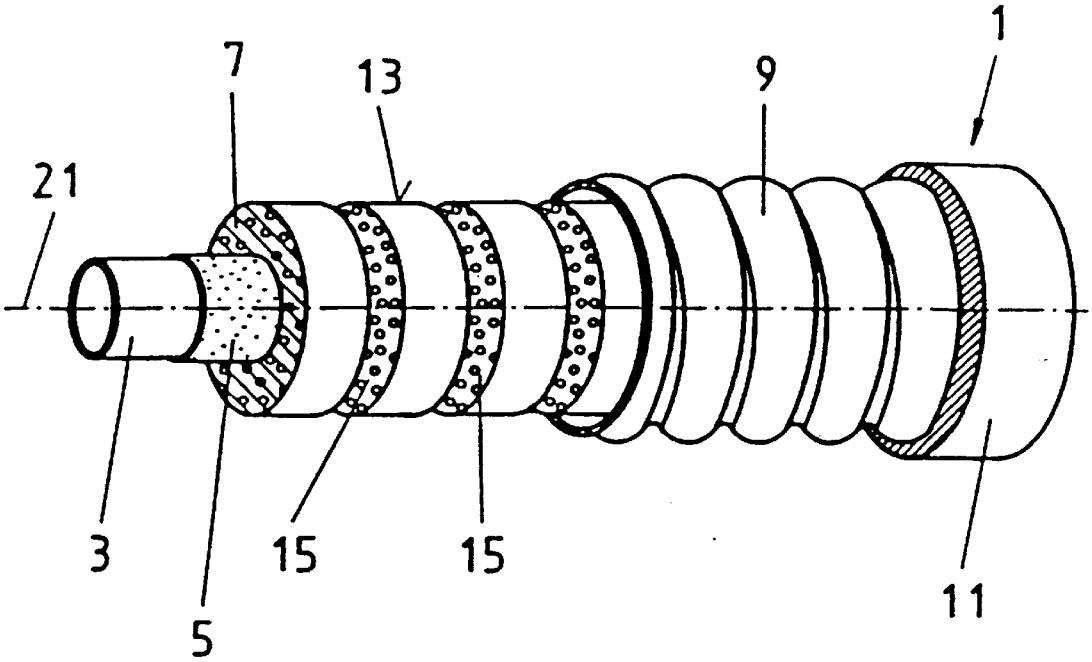

In the third embodiment of the invention illustrated in FIG. 3, the internal conductor 3 of the high frequency cable 1 is tubular in shape. Circular cutouts 15 extend radially inward from the periphery 13 of the insulating layer 7, while a full circular section of insulating layer 7 remains between adjacent annular cutouts 15 to ensure the longitudinal waterproof seal. In addition, the circular cutouts 15 increase the flexibility of the high frequency cable 1. For reasons of flexibility, in this embodiment, the external conductor 9 of the high frequency cable 1 is a corrugated longitudinally welded metal tube, which is enclosed by an electrically insulating outer jacket 11.

Figure 4:
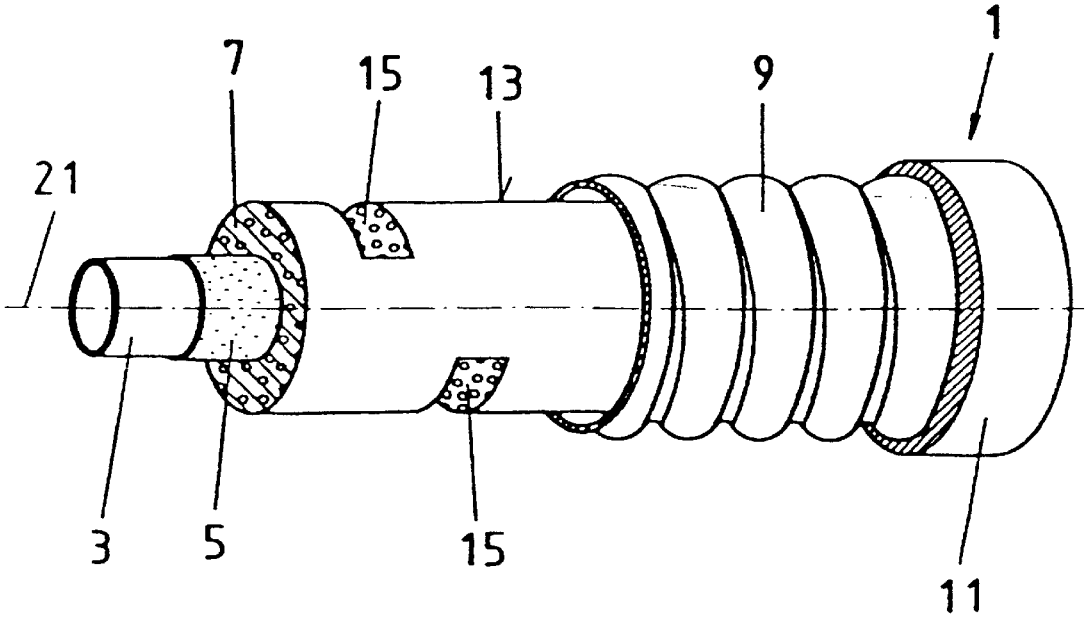

The fourth embodiment of a coaxial high frequency cable of the invention illustrated in FIG. 4 essentially differs from the third embodiment illustrated in FIG. 3 only in that the insulating layer 7 has substantially semi-circular segment cutouts 15 starting at its periphery 13 and extending radially inward to the surface of internal conductor 3.

Figure 5:
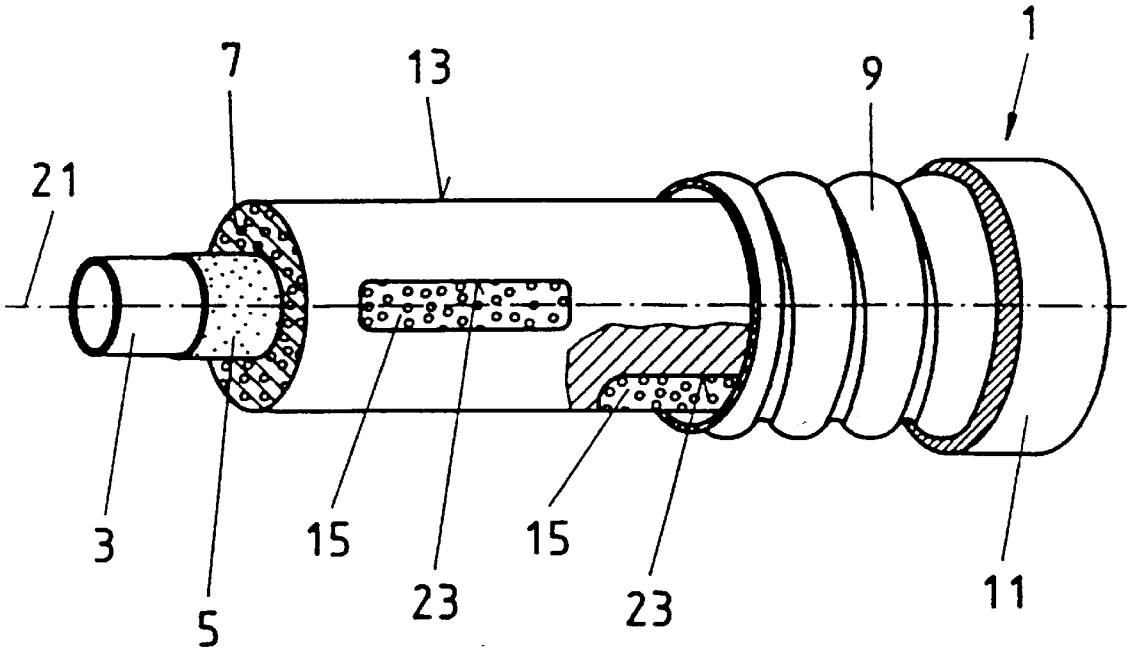

FIG. 5 depicts the fifth embodiment of the high frequency coaxial cable 1 with a tubular internal conductor 3 and a corrugated external conductor 9. The insulating layer 7 has cutouts 15 in the form of longitudinal slots 23 that run parallel to the longitudinal axis 21 of the high frequency cable 1. The longitudinal slots 23 are offset in the direction along the periphery of the insulating layer 7 at a distance from each other, so that the longitudinal waterproof seal of the high frequency cable is assured.

Care must be taken when arranging the cutouts 15, 15' in the insulating layer 7 of the high frequency cable 1, so that the periodic structure of the insulating layer 7 does not create any reflection factor peaks in the useful frequency range of the cable. The frequency of a reflection factor peak can be calculated as follows:

$$f = \frac{v_r \cdot 150}{100 \cdot l}$$

where f=the frequency of the reflection factor peak in MHz $v_r$=the relative propagation speed in % l=the length between equidistant structures in meters (m).

In the first two embodiments illustrated in FIGS. 1 and 2, length l is the pitch of the helical cutouts 15 or 15'. In the third embodiment illustrated in FIG. 3, it is the space between two adjacent circular cutouts 15. In the fourth embodiment illustrated in FIG. 4, it is the space between two adjacent substantially semi-circular segment cutouts 15.

For example a high frequency cable 1, which is to be used in the useful frequency range between 40 MHz and 3000 MHz, is designed with a relative propagation speed of $v_r$=92% in accordance with the revised formula:

$$l = \frac{v_r \cdot 150}{100 \cdot f}$$

so that the space between full sections 19, provided to ensure the longitudinal waterproof seal of the high frequency cable, is larger than 3.45 m and the pitch of the helical cutout 15 for example, or the space between adjacent circular cutouts 15, is smaller than 4.6 cm. In this way, the frequencies of reflection factor peaks in the useful frequency range of the high frequency cable 1 can be avoided.

Another way of avoiding reflections caused by the structure of the insulating layer 7 of the high frequency cable 1 would be to randomly select the pitch of helical cutouts 15, 15', or the spaces between adjacent circular or semi-circular segment cutouts 15, and possibly the spaces between adjacent full sections 19, along the length of the cable.

Figure 6:
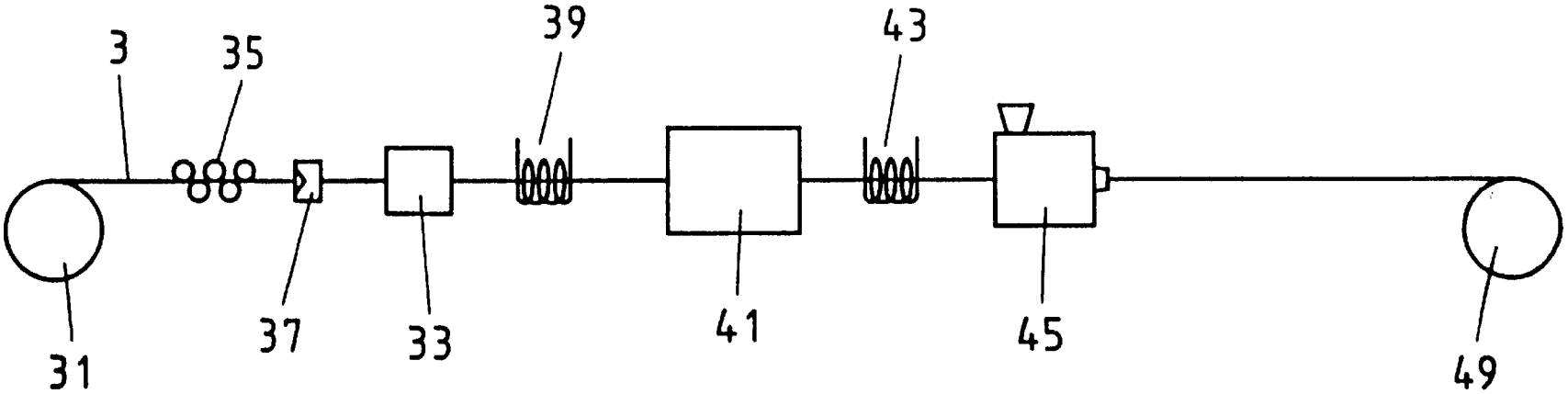
FIGS. 6–7 are diagrammatic views of the assembly line for manufacturing the high frequency coaxial cable of the present invention.

Turning now to FIG. 6, to manufacture a high frequency coaxial cable 1 according to the invention, first the internal conductor 3, in the form of a solid conductor wire or a metal tube, is continuously drawn from a storage reel 31 and advances to a cleaning station 33. If a metal wire is used as the internal conductor 3, it is first straightened in a straightening device 35 and then passes through a drawing tool 37 where it is drawn to have a smaller cross section. The metal surface of the internal conductor 3 is cleaned in the cleaning station 33 so that no grease residues remain. The internal conductor 3 then passes through a heating device 39 where it is heated. The hot internal conductor 3 now enters a coating chamber 41 in which a plastic powder is applied to the internal conductor 3, where the plastic powder melts onto the hot internal conductor 3, thus adhering to its surface. The applied plastic powder, for example an ethylene copolymer powder, is heated in another heating device 43, until a nearly uniform thin intermediate layer 5 is applied to the internal conductor 3. An extruder 45 then extrudes the insulating layer 7 made of a plastic foam, for example a polyethylene foam, over the internal conductor 3 which has been coated with the intermediate layer 5. The insulating layer 7 bonds firmly to the intermediate layer 5, so that the insulating layer 7 becomes a layer of uniform thickness. The insulated internal conductor 3 can be wound onto a reel 49 after the insulation material of insulating layer 7 has hardened.

Figure 7:
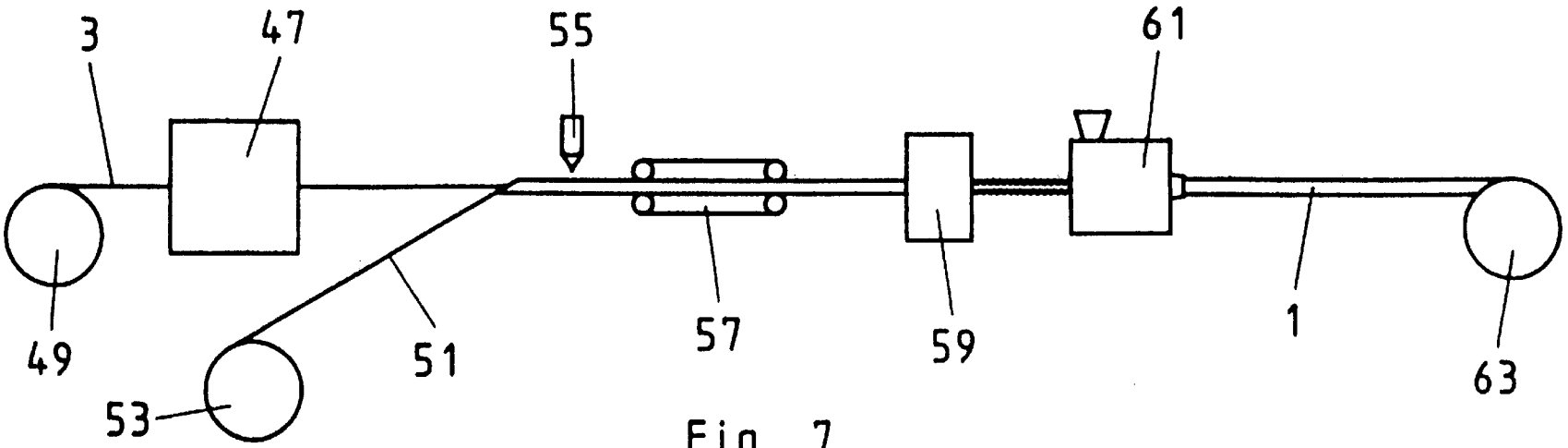
Figure 8:
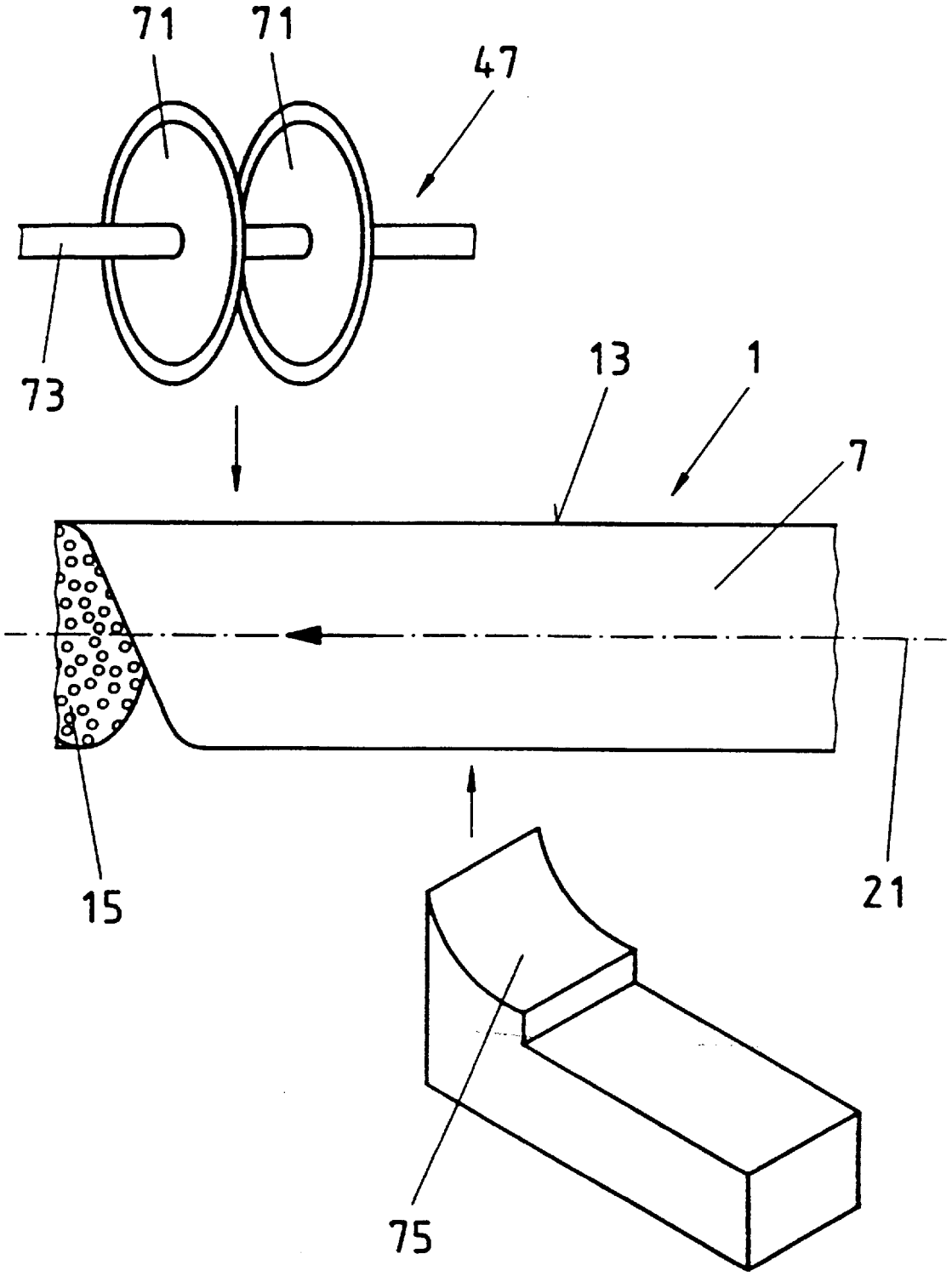
FIGS. 8–10 are diagrammatic views of the various tool devices used to remove portions of the insulating layer in practicing the method of the present invention.

In a subsequent operation illustrated in FIG. 7, insulation material is removed starting at the periphery 13 of insulating layer 7, by a tool device 47 illustrated in FIG. 8, with which cutouts 15 are made starting at the periphery 13 and extending radially into the insulating layer 7. Subsequently and continuously during the same operation, the internal conductor 3 equipped with insulating layer 7 is surrounded in tubular form by a longitudinal metal band 51 made of aluminum, an aluminum alloy, copper or a copper alloy, which is drawn from a storage reel 53, whose lengthwise seam is welded e.g. by an arc welding device 55, to form the tubular external conductor 9. A pull-off device 57 transports the unit comprising an internal conductor 3, intermediate layer 5, insulating layer 7 and external conductor 9 to a corrugating device 59 where the external conductor 9 is corrugated in helical or annular form. During corrugation, the external conductor 9 is pressed into the insulating layer 7 to form a strong mechanical connection therebetween and to fix the relative positions of the external conductor 9 and the internal conductor 3. An extruder 61 applies the outer jacket 11 to the external conductor 9. The thus manufactured high frequency cable 1 is then wound onto a storage reel 63.

FIG. 8 illustrates in essentially simplified form a tool device 47 used to form helical cutouts 15 in the insulating layer 7 of high frequency cable 1. The tool device 47 contains two parallel disk-shaped knives 71, which are spaced from each other. The two knives 71 are arranged either in a fixed or a rotating manner on a shaft 73, and rotate jointly around the longitudinal axis 21 of the high frequency cable 1. Two parallel cuts can be made by pressing the knives 71 into the insulation material of insulating layer 7. A scraping tool 75, which also rotates around the longitudinal axis 21 of high frequency cable 1, serves to remove the insulation material from between the two cuts by penetrating into the insulating layer 7 and thereby creates the helical cutouts 15. It is desirable if the knives 71 and the scraping tool 75 rotate together and at a constant distance around the longitudinal axis 21.

Figure 9:
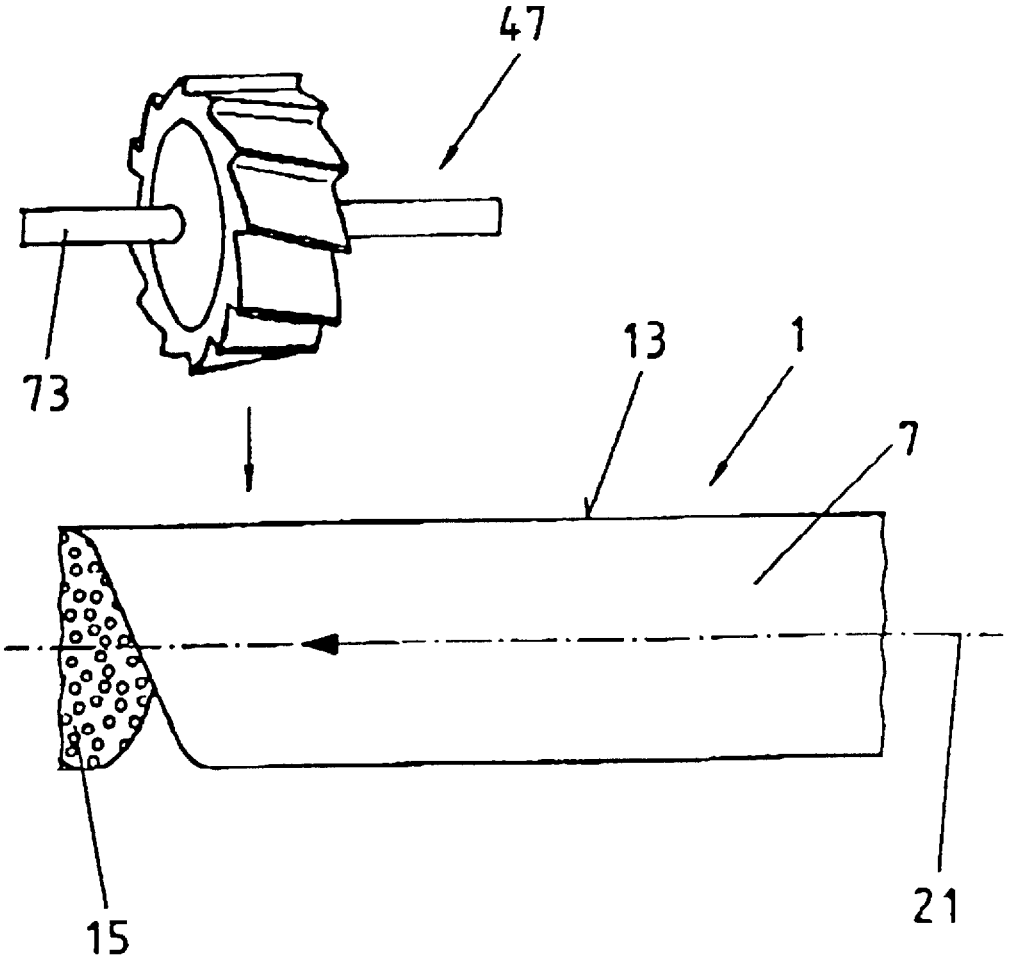
Figure 10:
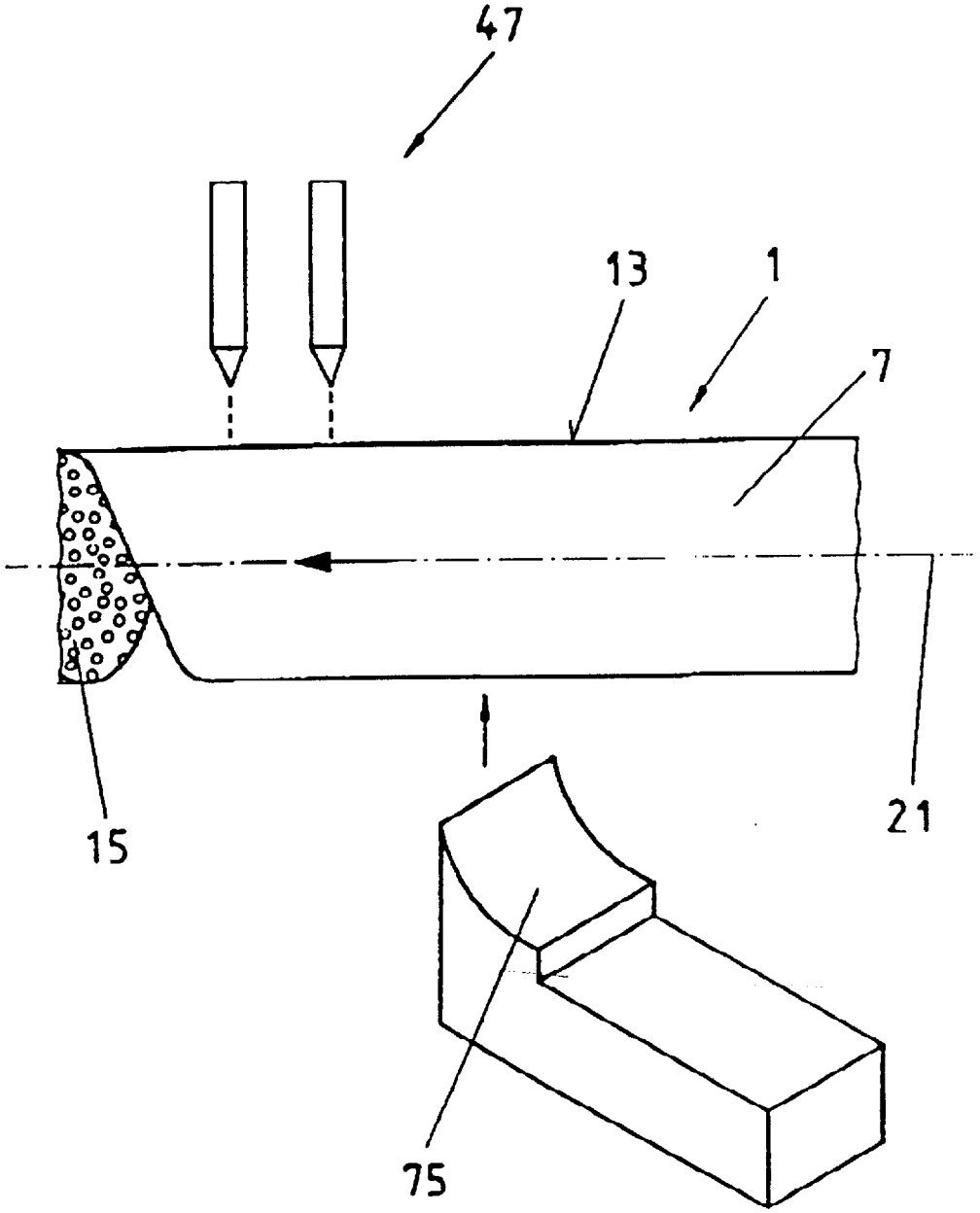

Other arrangements comprise the use of fixed knives, rotating saw blades or high pressure water jets 47 (FIG. 10) to make the two parallel running cuts in the insulating layer 7. It is also possible to remove the insulation material by use of a milling tool 47 mounted on rotatable shaft 73 as shown in FIG. 9.

If circular or semi-circular segment cutouts or longitudinal slots are to be made in the insulating layer 7, the knives 71 and the scraping tool 75 must of course be placed at different angles with respect to the longitudinal axis 21 than as shown in the example illustrated in FIG. 8 for producing helical cutouts 15. The width of the cutouts 15 can be changed by varying the distance between the two knives 71 and possibly the width of scraping tool 75.

The preferred embodiments described above admirably achieve the objects of the invention. However, it will be appreciated that departures can be made by those skilled in the art without departing from the spirit and scope of the invention which is limited only by the following claims.

What is claimed is:

1. A high frequency coaxial cable comprising:

(a) an internal conductor;

(b) a cylindrical insulating layer concentrically surrounding the internal conductor and being made of a foamed plastic containing more than 50% by volume of air, the cylindrical insulating layer having cutouts defined therein that extend radially inward starting at a periphery of the cylindrical insulating layer, the cutouts have a width in a range of between 10 and 50 mm and are formed by removing a portion of the foamed plastic from the cylindrical insulating layer;

(c) a tubular external conductor placed over the insulating layer; and (d) an outer sheath surrounding the tubular external conductor.

2. A high frequency cable as claimed in claim 1, wherein the cutouts extend radially inward to the internal conductor.

3. A high frequency cable as claimed in claim 1, further comprising an intermediate layer placed between the internal conductor and the insulating layer.

4. A high frequency cable as claimed in claim 3, wherein the cutouts extend radially inward to the intermediate layer.

5. A high frequency cable as claimed in claim 1, wherein the insulating layer contains cylindrical sections in which no cutouts have been made therein.

6. A high frequency cable as claimed in claim 5, wherein the cylindrical sections are spaced at least 2.0 meters apart.

7. A high frequency cable as claimed in claim 6, wherein the cylindrical sections are spaced apart by varying distances along the length of the cable.

8. A high frequency cable as claimed in claim 5, wherein the cylindrical sections are spaced apart by varying distances along the length of the cable.

9. A high frequency cable as claimed in claim 1, wherein the cutouts have a helical shape.

10. A high frequency cable as claimed in claim 9, wherein the helically shaped cutouts are of different pitch and overlap each other.

11. A high frequency cable as claimed in claim 9, wherein the helical cutouts have a pitch that does not exceed 7.5 cm.

12. A high frequency cable as claimed in claim 9, wherein the helical cutouts have a pitch that varies along the length of the cable.

13. A high frequency cable as claimed in claim 1, wherein the cutouts have a circular shape.

14. A high frequency cable as claimed in claim 13, wherein the circular shaped cutouts are spaced apart a distance not exceeding 7.5 cm.

15. A high frequency cable as claimed in claim 13, wherein the circular shaped cutouts are spaced apart distances that vary along the length of the cable.

16. A high frequency cable as claimed in claim 1, wherein the cutouts have a substantially semi-circular shape.

17. A high frequency cable as claimed in claim 16, wherein the semi-circular shaped cutouts are spaced apart a distance not exceeding 7.5 cm.

18. A high frequency cable as claimed in claim 16, wherein the semi-circular shaped cutouts are spaced apart distances that vary along the length of the cable.

19. A high frequency cable as claimed in claim 1, wherein the cutouts extend parallel to the longitudinal axis of the high frequency cable.

20. A high frequency cable as claimed in claim 1, wherein the foamed plastic contains more than 70% by volume of air.

21. A high frequency cable as claimed in claim 1, wherein the foamed plastic of the insulating layer is foamed polyethylene.

22. A high frequency cable as claimed in claim 9, wherein the helical cutouts have a pitch which is smaller than:

$$1 = \frac{v_r \cdot 150}{100 \cdot f}$$

where f=frequency of reflection factor peak in MHz;

$v_r$=relative propagation speed in %; and l=the pitch of the helical cutouts in meters.

23. A high frequency cable as claimed in claim 13, wherein there is a space between adjacent ones of said circular cutouts which is smaller than:

$$1 = \frac{v_r \cdot 150}{100 \cdot f}$$

where f=frequency of reflection factor peak in MHz;

$v_r$=relative propagation speed in %; and l=the pitch of the helical cutouts in meters.

24. A high frequency cable as claimed in claim 1, wherein the cutouts are formed after the foamed plastic is hardened.

* * * * *